US007527769B2

(12) United States Patent
Bunch et al.

(10) Patent No.: US 7,527,769 B2
(45) Date of Patent: May 5, 2009

(54) MICROTITRE PLATE WITH A RELIEVED PERIMETER

(75) Inventors: Richard P. Bunch, Reading, MA (US); Frederick D. Simmons, Milford, MA (US); Edward M. Alderman, Framingham, MA (US)

(73) Assignee: Caliper Life Sciences, Inc., Mountain View, CA (US)

( * ) Notice: Subject to any disclaimer, the term of this patent is extended or adjusted under 35 U.S.C. 154(b) by 320 days.

(21) Appl. No.: 11/381,815

(22) Filed: May 5, 2006

(65) Prior Publication Data

US 2007/0025885 A1 Feb. 1, 2007

Related U.S. Application Data

(60) Provisional application No. 60/678,625, filed on May 6, 2005.

(51) Int. Cl.
*B01L 3/00* (2006.01)

(52) U.S. Cl. ..... 422/102

(58) Field of Classification Search ..... None
See application file for complete search history.

(56) References Cited

U.S. PATENT DOCUMENTS

| | | | | |
|---|---|---|---|---|
| 4,545,958 | A | 10/1985 | Dopatka | |
| 2001/0027918 | A1 * | 10/2001 | Parce et al. | 204/452 |
| 2003/0049862 | A1 * | 3/2003 | He et al. | 436/180 |
| 2003/0129095 | A1 | 7/2003 | Farina | |

FOREIGN PATENT DOCUMENTS

| | | | |
|---|---|---|---|
| DE | 86 24 431 | U1 | 12/1986 |
| DE | 42 17 868 | A1 | 12/1993 |
| WO | WO 98/55232 | A | 12/1998 |

* cited by examiner

*Primary Examiner*—Jill Warden
*Assistant Examiner*—Timothy G Kingan
(74) *Attorney, Agent, or Firm*—Cardinal Law Group

(57) ABSTRACT

A microtitre plate having a relieved perimeter includes a plate defining a plurality of wells and the perimeter of the plate is horizontally relieved. Alternatively, a microtitre plate may include a base and a holding section extending from the base. The holding section defines a plurality of wells and the perimeter thereof being horizontally relieved.

16 Claims, 1 Drawing Sheet

MICROTITRE PLATE WITH A RELIEVED PERIMETER

BACKGROUND OF THE INVENTION

The earlier effective filing date of co-pending U.S. Provisional Application Ser. No. 60/678,625, entitled "Microtitre Plate With a Relieved Perimeter," filed May 6, 2005, in the name of the inventors Richard P. Bunch, et al. is hereby claimed and the application is hereby incorporated by reference for all purposes as if expressly set forth herein verbatim.

1. Field of the Invention

The present invention pertains to microtitre plates.

2. Description of the Related Art

Many types of testing dispose samples in the wells of a microtitre plate. Sometimes the samples are disposed directly into the wells. Other times, sample holders are used to transfer samples into or out of the wells of the microtitre plates. In commercial applications, the volume of testing is important both for economies of scale and for quick turnaround. Accordingly, robotic equipment has been developed to automate the testing, which includes the handling of microtitre plates.

The industry has also developed standards defining the dimensions and design of microtitre plates to facilitate the standardization of the robotic handling and testing machines. For instance, the Society of Biological Screening ("SBS") defines standards for microtitre plates having 96, 384, or 1,536 wells. Commercial pressures continue to push the design of the testing process, including the design of the handling equipment and microtitre plates, to increase the pace at which testing can be performed. However, these same commercial pressures also tend to constrain such improvements to be compatible with the installed base of the testing apparatus used by the industry.

One aspect of the testing process where these concerns intersect lies in the inability to access only a subset of the wells on the microtitre plate. For instance, the standards define a microtitre plate layout in which the wells are disposed in a two-dimensional array. The perimeter of the microtitre plate is thicker than the walls between the wells. Typically, the robotic handling machine will include a two-dimensional array of mandrels that engage a corresponding array of fluid dispensing tips disposed in a pattern matching that of the wells on the microtitre plate. The array of fluid dispensing tips is positioned over the microtitre plate and then lowered so that the tips are inserted into the wells.

This arrangement works quite well as long as the testing protocol calls for all of the wells on the microtitre plate to be treated both identically and contemporaneously. If for some reason only a subset of the wells on the microtitre plate are to be treated at some point, problems may arise. The thickened perimeter of the microtitre plate can prevent the array of fluid dispensing tips from simply being offset relative to the microtitre plate such that only a portion of the tips may be lowered into a subset of the wells to treat that subset. If this were attempted, the thickened perimeter would block the downward movement of the tips since they are spaced for the narrower width of the walls between the wells. Thus, testing protocols must either forego this strategy or employ longer, less efficient strategies to accomplish the same end.

The present invention is directed to resolving, or at least reducing, one or all of the problems mentioned above.

SUMMARY OF THE INVENTION

The invention, in its various aspects and embodiment, is a microtitre plate. In a first embodiment, a plate defines a plurality of wells and the perimeter of the plate is horizontally relieved. In a second embodiment, the microtitre plate comprises a base and a holding section extending from the base. The holding section defines a plurality of wells and the perimeter thereof being horizontally relieved.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

This invention is a microtitre plate that, in the illustrated embodiment, holds a plurality of pipet tips for automated liquid handlers, and for automated robotic handling. Note that, in alternative embodiments, the microtitre plate may be used to hold the samples themselves. The invention provides for robotic handling in the standard format used for microtitre plates without further modification. The perimeter of the microtitre plate is relieved to allow the liquid handler tip mandrels clearance in order to pick up row/column/individual tip subsets of the complete array.

Figure 1:
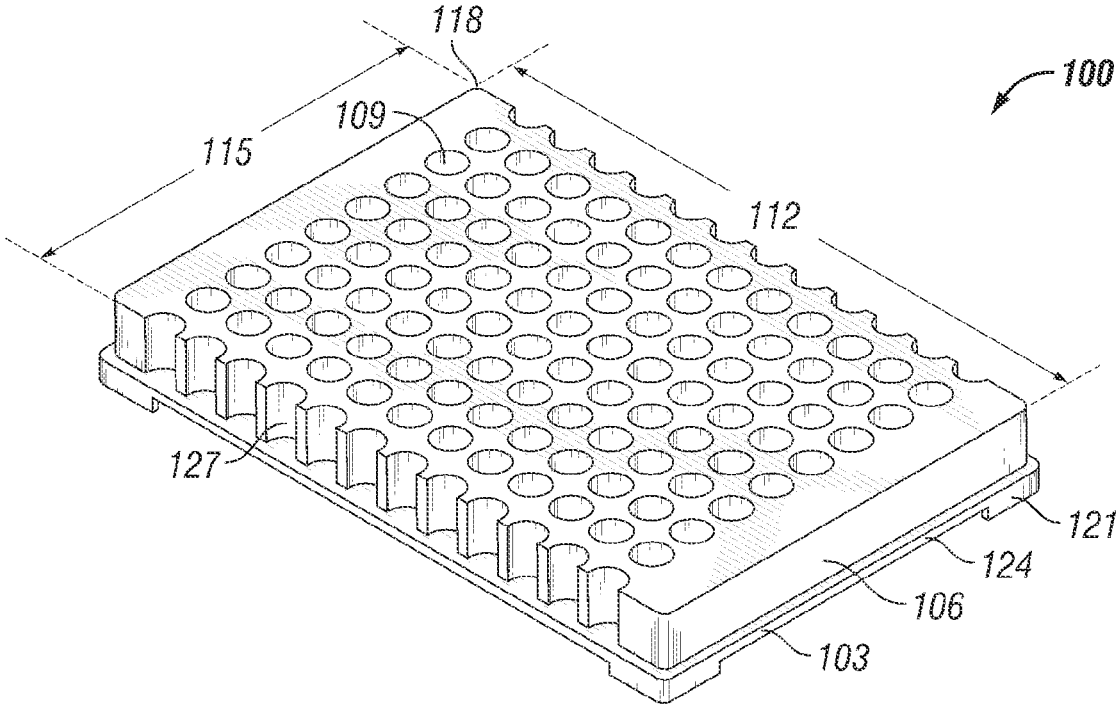
FIG. 1 illustrates a first embodiment of a microtitre plate in accordance with the present invention.

More particularly, FIG. 1 illustrates a microtitre plate 100 in a first embodiment in accordance with the present invention. The microtiter plate 100 comprises a base 103 and a holding section 106 extending from the base 103. The holding section 106 defines a plurality of wells 109 (only one indicated). The number of wells 109 is not material to the practice of the invention and will be implementation specific. In accordance with commonly accepted standards, the holding section 106 of the illustrated embodiment defines 96, 384, or 1,536 wells 109.

In this particular embodiment, the microtitre plate 100 has a rectangular geometry for both the base 103 and the holding section 106. Note that the base 103 and holding section 106 may have differing geometries in alternative embodiments. Because of the rectangular geometry, the microtitre plate 100 includes two long sides 112 and two short sides 115 (only one of each indicated) that define a perimeter 118 for the microtitre plate 100. Note that the terms "long" and "short" are defined relative to one another within the context of the rectangular geometry of the microtiter plate 100. The base 103 includes a number of legs 121 (only one indicated) and has a footprint slightly larger than that of the holding section 106, thereby defining a shoulder 124.

In accordance with the present invention, the perimeter 118 is horizontally relieved. In the illustrated embodiment, this is achieved by scalloping the long sides 112 of the holding section 106, i.e., the perimeter 118 defines a plurality of reliefs 127 (only one indicated) that are scallop-shaped. Note that, in alternative embodiments, the reliefs 127 may be alternatively shaped. For instance, in alternative embodiments, the reliefs 127 may be square-shaped notches rather than scalloped-shaped. Some alternative embodiments may also provide for that portion of the perimeter 118 defined by the base 103 to also be horizontally relieved. The reliefs 127 then permit the fluid dispensing tips to be lowered over the desired subset of the wells 109 because the perimeter, at least in part, is no longer thicker than the walls between the wells 109.

The microtitre plate 100 is a single piece fabricated by molding a suitable plastic. The manner in which the microtiter plate is fabricated is not material to the practice of the invention. For instance, the base 103 and holding section 106 may be separately fabricated and joined together. Or, the microtiter plate 100 may be fabricated from some material other than plastic. However, conventional microtiter plates are typically fabricated by molding a suitable plastic into a single piece. Any such fabrication technique may be modified for use in fabricating the present invention and those skilled in the art having the benefit of this disclosure will readily be able to do so.

Figure 2:
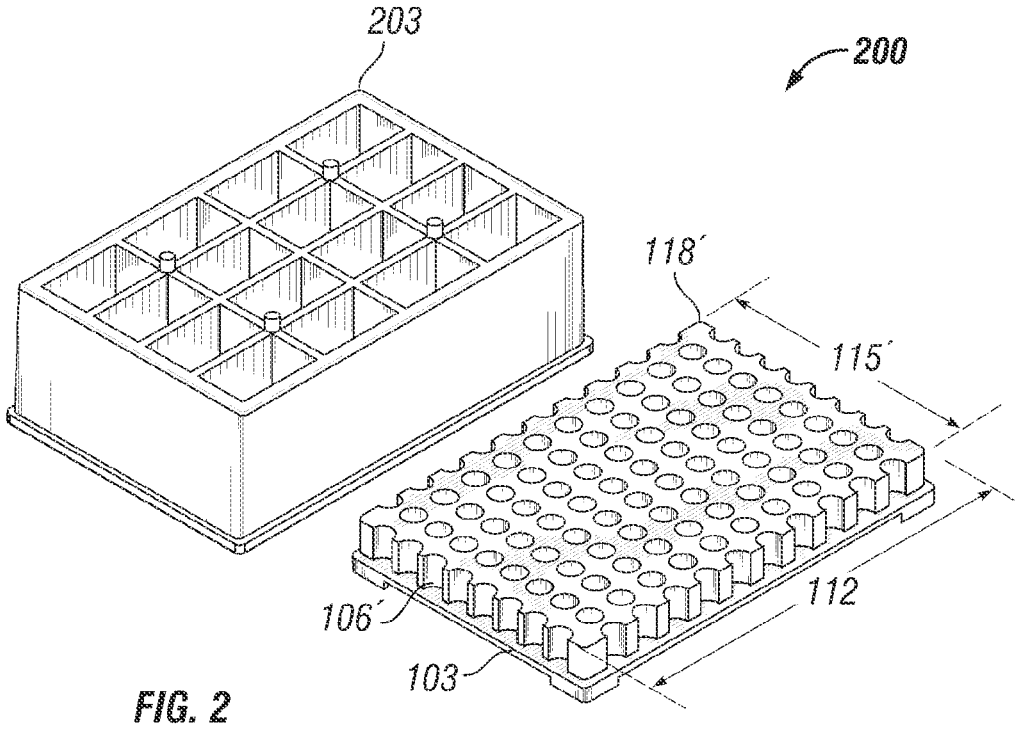
FIG. 2 illustrates a second embodiment of a microtitre plate in accordance with the present invention with an optional tip carrier.

Turning now to FIG. 2, a microtitre plate 200 in accordance with a second embodiment of the present invention is illustrated. FIG. 2 also shows an optional tip carrier 203 that may be snapped onto the microtitre plate 200 in some embodiments in accordance with conventional practice. The design of the microtitre plate 200 is similar to that of the microtitre plate 100, with like parts bearing like numbers. However, one difference is that the short sides 115' are also horizontally relieved. The additional row/column intersection presented by this difference permits the robotic handling equipment to pick up a single fluid dispensing tip at the corner 206 of the microtitre plate 200, which provides single well pipetting in addition to row/column pipetting for serial dilutions. The perimeter 118' of the microtitre plate 200 is designed with scalloped edges extending the pattern of locations that can accommodate an array of tips. This feature allows for the liquid handling head (not shown) to engage the tip carrier 203 for attachment of many combinations of rows/columns of tips, individual tips, or the entire array of tips, while still maintaining a standard contact perimeter for robotic tip tray handling.

Note that both the microtitre plates 100, 200 of FIG. 1, FIG. 2 are generally rectangular in shape. However, the geometry of the microtitre plate 100, 200 is not material to the present invention except to the extent that it conforms to applicable standard of interest. Depending on the tip box format (96/384/1,536/other), there may be geometric variations which allow for the attachments of rows/columns of tips while still maintaining a Society of Biological Screening ("SBS") standard perimeter for robotic plate handling. Note, however, that other standards setting bodies may implement alternative standards calling for alternative geometries. Some embodiments may also employ geometries and/or dimensions that are not standards-specific or do not comport with existing standards for microtitre plates. Thus, the geometry will be implementation specific.

Thus, the present invention permits the liquid handling robot (not shown) to attach individual tips, single rows, single columns, or whole arrays to a microtiter plate. A perimeter dimension is maintained that is the same as the standard perimeter dimensions of a microtitre plate. This allows for robotic handling of both microtitre plates and tip trays interchangeably without the need for mechanical conversion of robotic end effectors. This feature also provides for robotic tray detection by conventional gripper sensors of robotic equipment without touching the surface of the pipet tips themselves. The conventional plate sensors of conventional robotic equipment contact the plate/tray at the perimeter edges.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A microtitre plate comprising a plate defining a plurality of wells arranged in a plurality of rows, the wells having walls therebetween, the perimeter of the microtitre plate being relieved by a plurality of reliefs, each of the plurality of reliefs comprising a concavity, each of the plurality of reliefs being aligned with one of the plurality of rows, each of the plurality of reliefs having a wall between the relief and an adjacent well that is not thicker than the walls between the wells.

2. The microtitre plate of claim 1, wherein the plate defines 96, 384, or 1,536 wells.

3. The microtitre plate of claim 1, wherein the microtitre plate is rectangular in shape, having two long edges and two short edges.

4. The microtitre plate of claim 3, wherein the perimeter of the microtitre plate is relieved on the long edges thereof.

5. The microtitre plate of claim 4, wherein the perimeter of the microtitre plate is relieved on the short edges thereof.

6. The microtitre plate of claim 1, wherein the reliefs are scallop shaped.

7. A microtitre plate, comprising:

a base; and a holding section extending from the base, the holding section defining a plurality of wells arranged in a plurality of rows, the wells having walls therebetween, the perimeter of the holding section being relieved by a plurality of reliefs each of the plurality of reliefs comprising a concavity, each of the plurality of reliefs being aligned with one of the plurality of rows, each of the plurality of reliefs having a wall between the relief and an adjacent well that is not thicker than the walls between the wells.

8. The microtitre plate of claim 7, wherein the holding section defines 96, 384, or 1,536 wells.

9. The microtitre plate of claim 7, wherein the holding section is rectangular in shape, having two long edges and two short edges.

10. The microtitre plate of claim 9, wherein the perimeter of the holding section is relieved on the long edges thereof.

11. The microtitre plate of claim 10, wherein the perimeter of the holding section is relieved on the short edges thereof.

12. The microtitre plate of claim 7, wherein the reliefs are scallop shaped.

13. The microtitre plate of claim 1, wherein the reliefs are square shaped.

14. The microtitre plate of claim 7, wherein the reliefs are square shaped.

15. The microtitre plate of claim 1, wherein the reliefs are configured to allow clearance for an automated liquid handler to access a subset of the wells.

16. The microtitre plate of claim 7, wherein the reliefs are configured to allow clearance for an automated liquid handler to access a subset of the wells.

* * * * *